US009105242B2

(12) United States Patent
Matsubayashi

(10) Patent No.: US 9,105,242 B2
(45) Date of Patent: Aug. 11, 2015

(54) IMAGE DISPLAY SYSTEM, IMAGE DISPLAY APPARATUS AND CALIBRATION METHOD

(75) Inventor: Kazuhiro Matsubayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 244 days.

(21) Appl. No.: 13/472,110

(22) Filed: May 15, 2012

(65) Prior Publication Data

US 2012/0293400 A1 Nov. 22, 2012

(30) Foreign Application Priority Data

May 20, 2011 (JP) ..... 2011-113961
Mar. 6, 2012 (JP) ..... 2012-049238

(51) Int. Cl.
*G09G 3/36* (2006.01)
*G09G 5/10* (2006.01)
*G09G 3/34* (2006.01)

(52) U.S. Cl.
CPC ..... *G09G 3/3406* (2013.01); *G09G 2320/0666* (2013.01); *G09G 2320/0686* (2013.01); *G09G 2320/0693* (2013.01); *G09G 2360/145* (2013.01)

(58) Field of Classification Search
CPC ..... H04B 10/116; H04B 10/1143; H04B 10/541; H04N 5/2353; H04W 4/001; G09G 3/3233; G09G 3/3406; G06T 1/005; G06T 1/0085
See application file for complete search history.

(56) References Cited

U.S. PATENT DOCUMENTS

2003/0184738 A1* 10/2003 Yamaguchi ..... 356/213
2006/0087588 A1* 4/2006 Cok ..... 348/556
2007/0291048 A1* 12/2007 Kerofsky ..... 345/589
2008/0100645 A1* 5/2008 Nitta ..... 345/690

FOREIGN PATENT DOCUMENTS

JP 2006-145798 6/2006

* cited by examiner

*Primary Examiner* — Alexander Eisen
*Assistant Examiner* — Nan-Ying Yang
(74) *Attorney, Agent, or Firm* — Cowan, Liebowitz & Latman, P.C.

(57) ABSTRACT

A target value of a contrast ratio of an image display apparatus is set, and the number of levels, among which the luminance of a backlight is changed over, and each level of luminance are decided according to the target value of the contrast ratio. The backlight is made to emit light at the individual levels of luminance of the backlight thus decided, and at the same time, the image display apparatus is made to display a predetermined color chart thereon, so that color measurement is thereby carried out, and calibration is carried out at each level of luminance of the backlight based on a color value thus measured. The calibration is carried out only on an appropriate number of levels of the luminance of the backlight required to achieve the target value of the contrast ratio.

20 Claims, 9 Drawing Sheets

| LOCAL DIMMING | TARGET CONTRAST RATIO | NUMBER OF LEVELS (N) | DISPLAY LUMINANCE RANGE AT EACH BACKLIGHT LUMINANCE CONTROL LEVEL (% WITH RESPECT TO WHITE COLOR LUMINANCE) | | | | |
|---|---|---|---|---|---|---|---|
| ON | 1000:1 OR LESS | 1 | 0.1% ～100% | | | | |
| ON | FROM 1,000:1 TO 2,000:1 | 3 | 0.1% ～100% | 0.07% ～70% | 0.05% ～50% | | |
| ON | FROM 2,000:1 TO 4,000:1 | 5 | 0.1% ～100% | 0.07% ～70% | 0.05% ～50% | 0.035% ～35% | 0.025% ～25% |
| OFF | ALL | 1 | 0.1% ～100% | | | | |

*Fig.4*

| CALIBRATION TARGET VALUE | | | BACKLIGHT LUMINANCE CONTROL LEVELS | | | | | |
|---|---|---|---|---|---|---|---|---|
| WHITE COLOR LUMINANCE (cd/m²) | BLACK COLOR LUMINANCE (cd/m²) | CONTRAST RATIO | NUMBER OF LEVELS (N) | DISPLAY LUMINANCE RANGE AT EACH BACKLIGHT LUMINANCE CONTROL LEVEL (cd/m²) | | | | |
| 400 | 0.4 | 1000:1 | 1 | 0.4 ~400 | | | | |
| 400 | 0.2 | 2000:1 | 3 | 0.4 ~400 | 0.28 ~280 | 0.2 ~200 | | |
| 400 | 0.1 | 4000:1 | 5 | 0.4 ~400 | 0.28 ~280 | 0.2 ~200 | 0.14 ~140 | 0.1 ~100 |

*Fig.5A*

| CALIBRATION TARGET VALUE | | | BACKLIGHT LUMINANCE CONTROL LEVELS | | | | | |
|---|---|---|---|---|---|---|---|---|
| WHITE COLOR LUMINANCE (cd/ m²) | BLACK COLOR LUMINANCE (cd/ m²) | CONTRAST RATIO | NUMBER OF LEVELS (N) | DISPLAY LUMINANCE RANGE AT EACH BACKLIGHT LUMINANCE CONTROL LEVEL (cd/ m²) | | | | |
| 100 | 0.025 | 4000:1 | 5 | 0.1 ~100 | 0.07 ~70 | 0.05 ~50 | 0.035 ~35 | 0.025 ~25 |
| 200 | 0.05 | 4000:1 | 5 | 0.2 ~200 | 0.14 ~140 | 0.1 ~100 | 0.07 ~70 | 0.05 ~50 |
| 400 | 0.1 | 4000:1 | 5 | 0.4 ~400 | 0.28 ~280 | 0.2 ~200 | 0.14 ~140 | 0.1 ~100 |

*Fig.5B*

| CALIBRATION TARGET VALUE | | | BACKLIGHT LUMINANCE CONTROL LEVELS | | | | | |
|---|---|---|---|---|---|---|---|---|
| WHITE COLOR LUMINANCE (cd/ m²) | BLACK COLOR LUMINANCE (cd/ m²) | CONTRAST RATIO | NUMBER OF LEVELS (N) | DISPLAY LUMINANCE RANGE AT EACH BACKLIGHT LUMINANCE CONTROL LEVEL (cd/ m²) | | | | |
| 100 | 0.1 | 1000:1 | 1 | 0.1 ~100 | | | | |
| 200 | 0.1 | 2000:1 | 3 | 0.1 ~100 | 0.14 ~140 | 0.2 ~200 | | |
| 400 | 0.1 | 4000:1 | 5 | 0.1 ~100 | 0.14 ~140 | 0.2 ~200 | 0.28 ~280 | 0.4 ~400 |

*Fig.5C*

IMAGE DISPLAY SYSTEM, IMAGE DISPLAY APPARATUS AND CALIBRATION METHOD

BACKGROUND OF THE INVENTION

1. Field of the Invention

The present invention relates to an image display system, an image display apparatus and a calibration method.

2. Description of the Related Art

A color liquid crystal display forms a color image by controlling the luminance of a backlight, and the transmittance of each liquid crystal cell. The pixel value of an input image signal is represented, for example, by a value of 256 steps or levels, with respect to an R (red) component, a G (green) component, and a B (blue) component, respectively. A liquid crystal driving signal (drive voltage) is decided from the above-mentioned pixel value through a matrix operation or through reference to a look-up table, so that the liquid crystal transmittance can be controlled by providing the drive voltage to a liquid crystal driving unit.

The color liquid crystal display (hereinafter referred to as a calibration display), which is provided with a calibration function to be carried out by a personal computer, measures the luminance and the chromaticity of each of a plurality of color charts displayed on a screen. The calibration display adjusts arithmetic operation (i.e., computation) parameters and the look-up table for deciding a backlight driving signal (a drive electric current or a pulse width modulation duty ratio) and the liquid crystal driving signal. According to this, it is possible to manage so as to make smaller an error or difference between a color which should be displayed and a color which is actually displayed. With the general calibration display, a user sets one set of calibration desired or target values such as a white color luminance, a black color luminance (or a contrast ratio=white color luminance/black color luminance), a white chromaticity, a color gamut, a gamma coefficient, and so on.

The calibration display displays, at least, a color chart of three primary colors for adjusting the color gamut, a white color chart for adjusting white chromaticity, a black color chart for adjusting black color luminance, a white color chart for adjusting white color luminance, and a plurality of gray color charts for adjusting a gamma curve. The calibration display adjusts the arithmetic operation parameters and the look-up table values for deciding the backlight driving signal and the liquid crystal driving signal so as to meet the set calibration target values.

There is a display which divides a backlight into a plurality of light source blocks, and carries out variable control of the luminance of the backlight for each of the light source blocks. According to such a local dimming display, there will be obtained such effects as an improvement in the contrast ratio or a reduction in the power consumption. There are some display devices in which the luminance of an entire backlight is changed in a uniform manner according to an image signal to be inputted, without dividing alight source into blocks, but in the following description, such display devices are handled as a kind of dimming display (i.e., dimming with the number of light source blocks being 1).

The characteristics of the arithmetic parameters and the look-up table for deciding the backlight driving signal and the liquid crystal driving signal according to the image signal to be inputted vary with the luminance of the backlight. For that reason, in the case of local dimming displays in which the luminance of the backlight can be switched or changed over among a plurality of levels of luminance, it is necessary to carry out a calibration with respect to each of the plurality of levels of backlight luminance.

In the patent gazette of Japanese patent application laid-open No. 2006-145798, there is described a technique which, in a local dimming display, measures the luminance and the chromaticity of each of a plurality of color charts displayed on a screen, and adjusts arithmetic operation parameters and a look-up table for deciding a liquid crystal driving signal from a pixel value to be inputted.

SUMMARY OF THE INVENTION

In the calibration described in the official gazette of Japanese patent application laid-open No. 2006-145798, the calibration is carried out with respect to all the levels of luminance of the backlight into which the backlight luminance can be switched or changed over, and hence, there will be a problem that the time taken to carry out the calibration may become huge.

Accordingly, the present invention provides a technique which serves to suppress the time required to carry out calibration from becoming long, in an image display apparatus provided with a backlight which can be changed over among a plurality of levels of luminance.

A first mode of the present invention resides in an image display apparatus having a display panel, and a backlight adapted to be changed over among a plurality of levels of luminance, said apparatus comprising: a setting unit that sets a target value for a predetermined display characteristic of said image display apparatus; a decision unit that decides, based on said target value, the number of levels of change-over of the luminance of said backlight and each level of luminance; and a calibration unit that carries out color measurement by causing said backlight to emit light at each level of luminance decided by said decision unit and causing said image display apparatus to display a predetermined color chart thereon, and carries out calibration at each level of luminance of said backlight based on a color value thus measured.

A second aspect of the present invention resides in a calibration method for an image display apparatus having a display panel and a backlight adapted to be changed over among a plurality of levels of luminance, said method comprises: a setting step to set a target value for a predetermined display characteristic of said image display apparatus; a decision step to decide, based on said target value, the number of levels of change-over of the luminance of said backlight and each level of luminance; and a calibration step to carry out color measurement by causing said backlight to emit light at each level of luminance decided in said decision step and causing said image display apparatus to display a predetermined color chart thereon, and to carry out calibration at each level of luminance of said backlight based on a color value thus measured.

A third mode of the present invention resides in an image display system which is provided with an image display apparatus having a display panel and a backlight adapted to be changed over among a plurality of levels of luminance, and a calibration device that carries out color measurement by causing said image display apparatus to display a predetermined color chart thereon, and carries out calibration of said image display apparatus based on a color value thus measured. Said calibration device comprises: a setting unit that sets a target value for a predetermined display characteristic of said image display apparatus; a target value transmission unit that transmits said target value to said image display apparatus; a luminance level obtaining unit that obtains, from said image display apparatus, information on the number of levels of change-over of the luminance of said backlight and each level of the luminance decided based on said target value; and a calibration unit that carries out color measurement by causing said backlight to emit light at each level of the luminance obtained by said luminance level obtaining unit and causing said image display apparatus to display a predetermined color chart thereon, and carries out calibration at each level of luminance of said backlight based on a color value thus measured. Said image display apparatus comprises: a target value obtaining unit that obtains said target value for the predetermined display characteristic from said calibration device; a decision unit that decides, based on said target value, the number of levels of change-over of the luminance of said backlight and each level of luminance; and a luminance level transmission unit that transmits information on said number of levels and each level of luminance decided by said decision unit to said calibration device.

According to the present invention, it becomes possible to suppress the time required to carry out calibration from becoming long, in an image display apparatus provided with a backlight which can be changed over among a plurality of levels of luminance.

Further features of the present invention will become apparent from the following description of exemplary embodiments with reference to the attached drawings.

BRIEF DESCRIPTION OF THE DRAWINGS

FIG. 4 is an example of the correlation relation between calibration target values and the number of change-over levels of luminance required.

FIGS. 5A through 5C are examples of the correlation relation between calibration target values and the number of change-over levels of luminance required, respectively.

DESCRIPTION OF THE EMBODIMENTS (First Embodiment)

Figure 1A:
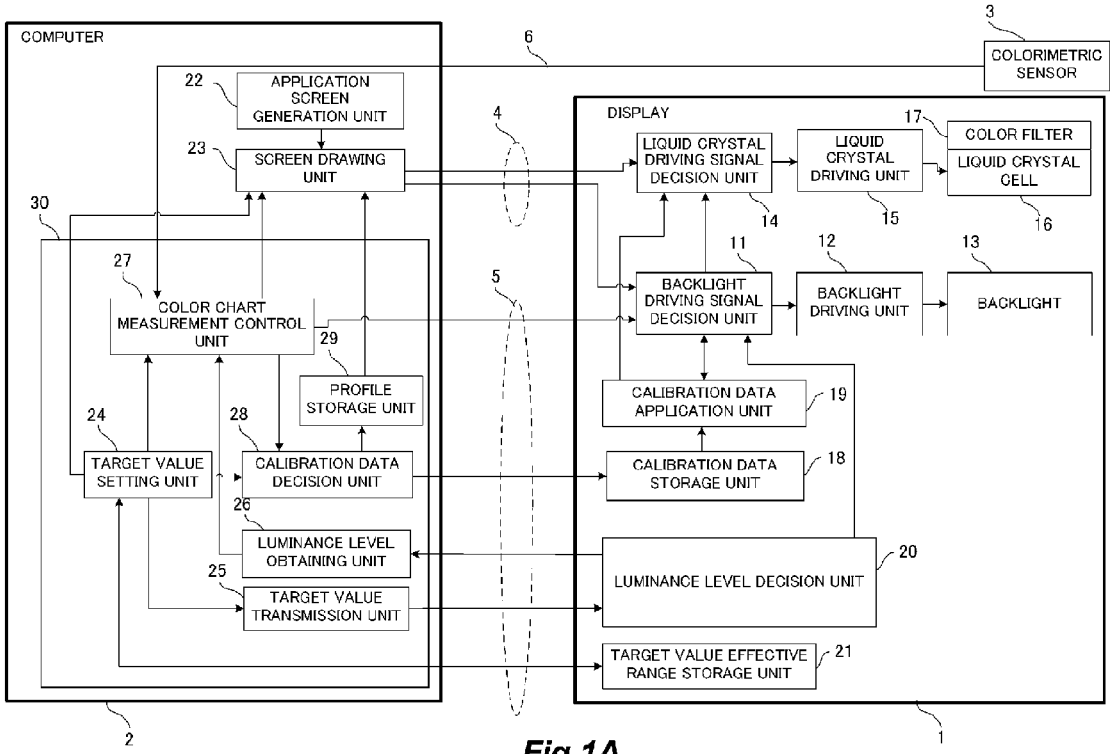
FIGS. 1A and 1B are system construction diagrams, respectively, of an image display system according to a first embodiment of the present invention.

FIG. 1A is a construction diagram of an image display system according to a first embodiment of the present invention. A color liquid crystal display (hereinafter referred to as a display) 1 is an image display apparatus which receives, as an input, an image signal outputted by a computer 2 through an image signal cable 4, and displays it on a screen. The computer 2 is a calibration device which serves to calibrate the display 1, and at the time of carrying out the calibration, the computer 2 outputs an image signal for displaying a color chart to the display 1 through the image signal cable 4. Moreover, the computer 2 controls a backlight driving signal and a liquid crystal driving signal for the display 1 through a display control cable 5, so that the displayed color of the color chart is thereby adjusted.

In the computer 2, a control program (software) which calibrates the display 1 is supplied by a portable type recording media (e.g., CD-ROM, etc.) or through the Internet, and is installed on the computer 2. Then, a CPU (central processing unit) of the computer 2 reads out and executes the control program, so that the calibration of the display 1 is thereby carried out. Alternatively, it may be constructed such that a storage device with a calibration control program stored therein is provided, and calibration control is carried out by reading out the program therefrom and executing the same. Accordingly, a computer program for achieving the function of the above-mentioned forms of embodiment itself is one form of the present invention. A colorimetric or color measurement sensor 3 is a sensor which serves to measure the luminance and the chromaticity of an image displayed on a predetermined area of the display 1. The predetermined area is an area in which a color chart for calibration processing is to be displayed.

The computer 2 reads the measured data of the luminance and the chromaticity obtained by the above-mentioned colorimetric sensor 3 from a colorimetric sensor cable 6. The computer 2 carries out the calibration of the display 1 based on the measurement results of the luminance and the chromaticity. Parameters and/or look-up tables are adjusted by means of the calibration. The parameters and/or the look-up tables are tables which specify the correlation relation for deciding driving signals for a backlight and a liquid crystal panel (liquid crystal display panel) according to an image signal to be inputted, and are stored in the storage device of the display 1. The data (calibration data) of the calibration results of the parameters and/or the look-up tables is transmitted to the display 1 by way of the display control cable 5.

Now, reference will be made to an operation of the image display system of the first embodiment at the time of displaying an image. The computer 2 has an application screen generation unit 22, a screen drawing unit 23, and a calibration control unit 30. The application screen generation unit 22 is a processing unit for processing arbitrary application software, and serves to generate a screen including a GUI (graphical user interface), a still or stationary image, a dynamic or moving image, and so on, and to output it to the screen drawing unit 23.

The screen drawing unit 23 is a processing unit for an operating system and/or drivers, and serves to carry out the drawing of graphics of the GUI as well as the decoding and drawing of the still image and the dynamic image, which are inputted thereto from the application screen generation unit 22, and also to carry out color management processing, etc. The screen drawing unit 23 decides the pixel value of each pixel of the image signal, and outputs it to a liquid crystal driving signal decision unit 14 and a backlight driving signal decision unit 11. The pixel value of each pixel is represented, for example, by a value of 256 steps or levels (eight bits for each color component), with respect to an R (red) component, a G (green) component, and a B (blue) component, respectively.

The calibration control unit 30 carries out the calibration of the display 1. The calibration control unit 30 has a target value setting unit 24, a target value transmission unit 25, a luminance level obtaining unit 26, a color chart measurement control unit 27, a calibration data decision unit 28, and a profile storage unit 29. The details of the operation of the calibration control unit 30 will be described later.

The display 1 is provided with a local dimming function. That is, the backlight 13 can be changed in luminance according to the input image signal. In addition, the backlight 13 is divided into a plurality of light source blocks which can be changed over in luminance independently of one another, so that the luminance can be switched or changed over for each light source block according to the brightness of the image in a display area (hereinafter referred to as a divided display area) on the liquid crystal panel which corresponds to the light source block. In this embodiment, the luminance of each light source block is switched or changed over by selecting one level of luminance from among a predetermined number of levels (N) of luminance, so that the luminance of the backlight is switched or changed over by the use of local dimming control. In other words, for each light source block, any one level of luminance among the N levels is selected, so that the luminance thereof is changed over to the selected level of luminance. The luminance control of the backlight 13 is carried out by means of the backlight driving signal decision unit 11.

The backlight driving signal decision unit 11 determines the brightness of the image in each of the divided display areas based on the statistics of the pixel values (e.g., a maximum value of each of RGB component values) of the image signal which correspond to the above-mentioned individual divided display areas, respectively. That is, the backlight driving signal decision unit 11 decides the level of the luminance of a light source block corresponding to each divided display area, according to the brightness of the image in each divided display area. The backlight driving signal decision unit 11 obtains the backlight driving signal from the level of the luminance thus decided, by means of arithmetic (calculation) operation or with reference to the look-up tables, and outputs it to a backlight driving unit 12. A correspondence or correlation relation for selecting, from the brightness of the image in a divided display area, the level of the luminance of that light source block which corresponds to that divided display area, and a correspondence or correlation relation for obtaining the backlight driving signal from the selected level of luminance, have been stored in a calibration data storage unit 18. These correspondence or correlation relations are stored as arithmetic operation expressions or look-up tables. The backlight driving signal decision unit 11 obtains the backlight driving signal by carrying out arithmetic calculation operations based on the arithmetic operation expressions, or by referring to the look-up tables.

The backlight driving unit 12 decides, for each above-mentioned light source block, a drive current value and a pulse width modulation duty ratio based on the backlight driving signal inputted from the backlight driving signal decision unit 11, so that it thereby drives the backlight 13. The individual light source blocks, which together construct the backlight 13, are each composed of one or more LEDs (light emitting diodes), respectively, and each LED emits light at an intensity or level of luminance according to the drive current value and the pulse width modulation duty ratio. The LEDs are white LEDs or RGB-LEDs. The RGB-LEDs are composed of LEDs of three colors, i.e., R (red), G (green) and B (blue), and lights of three colors emitted from the individual LEDs, respectively, are mixed together with one another to form white light.

The liquid crystal driving signal decision unit 14 decides a liquid crystal driving signal for each RGB sub pixel based on the illuminance of each pixel by the irradiation light thereto from the backlight 13 and the pixel value of each pixel, and outputs it to a liquid crystal driving unit 15. The illuminance of the irradiation light from the backlight 13 is calculated for each light source block based on the drive current value and the pulse width modulation duty ratio which are obtained from the backlight driving signal decision unit 11. The pixel value of each pixel is obtained from the screen drawing unit 23. A relation for obtaining the liquid crystal driving signal from the illuminance of the irradiation light from the backlight 13 and the pixel values of the input image signal has been stored in the calibration data storage unit 18 as arithmetic operation expressions or look-up tables. The liquid crystal driving signal decision unit 14 obtains the liquid crystal driving signal by carrying out arithmetic calculation operations based on the arithmetic operation expressions, or by referring to the look-up tables.

The liquid crystal driving unit 15 decides a liquid crystal driving voltage for each RGB sub pixel based on the liquid crystal driving signal decided by the liquid crystal driving signal decision unit 14, and drives a liquid crystal cell 16. The liquid crystal cell 16 has an optical transmittance which changes in accordance with the above-mentioned liquid crystal driving voltage inputted from the liquid crystal driving unit 15. The white light emitted from the backlight 13 transmits through the liquid crystal cell 16 at the optical transmittance decided according to the pixel value thereof, and further transmits through a light filter 17, so that a color image based on the image signal inputted is thereby displayed on the display 1. The liquid crystal panel is composed of the liquid crystal cell 16 and the light filter 17.

The arithmetic operation parameters and the data of the look-up tables used at the time when the backlight driving signal decision unit 11 decides the backlight driving signal and at the time when the liquid crystal driving signal decision unit 14 decides the liquid crystal driving signal are rewritten or updated by calibration. The calibration is carried out at each level of luminance of the backlight which is switched or changed over by means of the local dimming control. The arithmetic parameters and the data of the look-up tables adjusted by the calibration vary according to the levels of the luminance of the backlight. The arithmetic operation parameters and the data of the look-up tables adjusted by the calibration are referred to as calibration data.

The calibration data, which correspond to the plurality of individual levels of luminance, respectively, changed over by means of the local dimming control, have been stored in the calibration data storage unit 18. The calibration data corresponding to the individual levels of luminance of the backlight can be read in by referring to the addresses set according to the individual levels of luminance of the backlight, respectively. A calibration data application unit 19 refers for each of the above-mentioned light source blocks to an address corresponding to the level of the luminance of the backlight set in that light source block. In this way, the calibration data application unit 19 reads in the calibration data corresponding to the individual levels of the luminance from the calibration data storage unit 18. The calibration data read in by the calibration data application unit 19 is referred to by means of the backlight driving signal decision unit 11 and the liquid crystal driving signal decision unit 14.

Now, reference will be made to the calibration processing of the display 1 by means of the calibration control unit 30 while using a flow chart of FIG. 2 and examples of a target value setting screen of FIGS. 3A through 3C. In step S101, the target value setting unit 24 sets an initial value of each calibration target value. This initial value is the default value at the time of factory shipment at the first calibration of the display, and is the value set at the last calibration at the time of the second and thereafter calibration.

The calibration target values are target values of the display characteristics of the image display apparatus, and are settings of white color luminance, white chromaticity, black color luminance, contrast ratio, color gamut (three primary color chromaticities), gamma coefficient, validity or invalidity (on or off) of local dimming, and so on. Here, note that these calibration target values are mentioned by way of example only, but the target values of all these display characteristics may not be included, or target values for display characteristics other than these may also be included. In addition, the target value setting unit 24 has beforehand obtained an effective range of each target value (i.e., a range of possible setting values as a target value) from the target value effective range storage unit 21 of the display 1 through the display control cable 5.

In step S102, the target value transmission unit 25 transmits the calibration target values to a luminance level decision unit 20 of the display 1. The luminance level decision unit 20 obtains the target values thus transmitted from the target value transmission unit 25. The calibration target values to be transmitted are the initial values set in step S101 or the calibration target values updated according to an input by a user in step S106, which will be described later.

In step S103, the luminance level obtaining unit 26 obtains, from the luminance level decision unit 20 of the display 1, the number of levels (N) of luminance of the backlight among which the backlight can be changed over by means of local dimming and the range of display luminance in each luminance level. The details thereof will be described later.

Figure 3A:
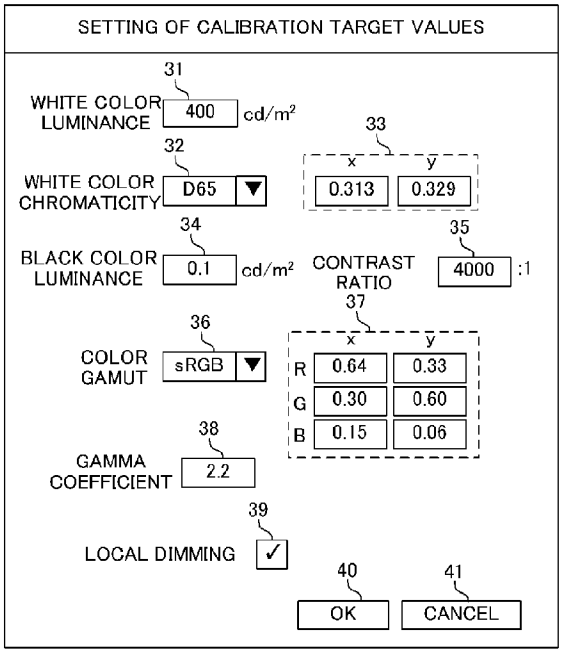
FIGS. 3A through 3C are examples of a target value setting screen in the first embodiment of the present invention.
Figure 3B:
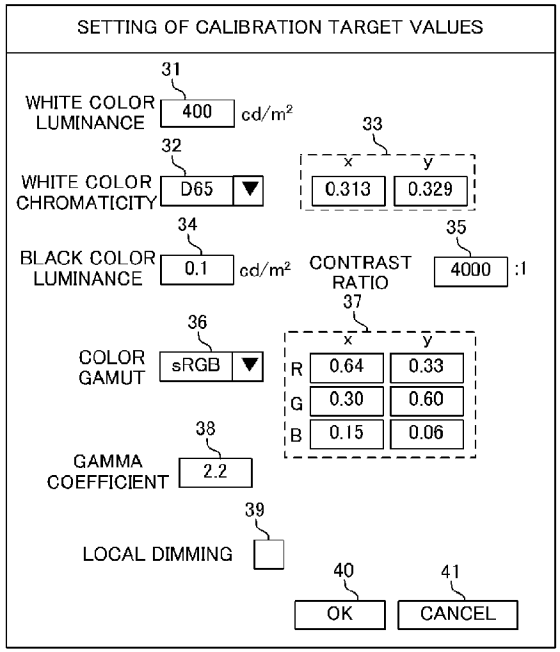
Figure 3C:
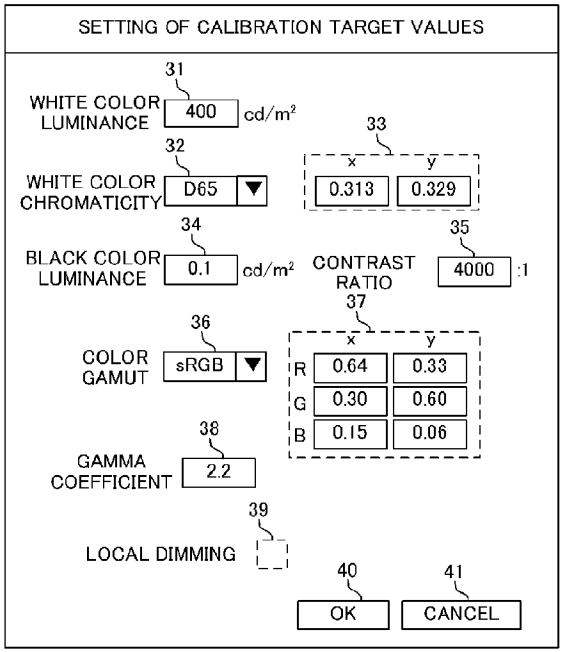

In step S104, the target value setting unit 24 instructs the screen drawing unit 23 to generate and draw graphics data which construct the GUI of a calibration target value setting screen, as shown in FIGS. 3A through 3C. In response to this instruction, the screen drawing unit 23 displays the GUI constructing the calibration target value setting screen on the display 1. The computer receives the setting of the target values (i.e., numerical inputs, selection from a list, checking of check boxes, etc.) through the GUI by operation of the user through input devices such as an unillustrated keyboard, a mouse, etc.

In step S105, in cases where there is an input in any of input or entry boxes 31 through 39 of the calibration target value setting screen, the processing of step S106 is carried out. In cases where there is no input, the processing of step S107 is carried out.

In step S106, according to the above-mentioned input, the target value setting unit 24 sets the values of all the target values in such a manner that in cases where the value of the input is out of the effective range, it replaces the input value with an effective value, or calculates the value of a related box (e.g., calculates a contrast ratio from white color luminance and black color luminance, etc.). Then, returning to step S102, the target value transmission unit 25 transmits the latest or updated calibration target values to the luminance level decision unit 20 of the display 1.

The target value setting unit 24 returns to step S102 where it continues to display the calibration target value setting screen, until an OK button 40 on the calibration target value setting screen is clicked in step S107. When it is detected that the OK button 40 on the calibration target value setting screen has been clicked, the target value setting unit 24 makes an instruction to the screen drawing unit 23 so that the display of the calibration target value setting screen is ended, and then goes to step S108.

In steps S108, S110 and S111, the execution of the processing of step S109 is carried out N times in a repeated manner (N being the above-mentioned number of change-over steps or levels of the luminance of the backlight). The processing of step S109 is processing in which the backlight is caused to emit light at the individual levels of luminance in the change-over of the luminance of the backlight obtained by the luminance level obtaining unit 26, and in which an image signal for a color chart is inputted to the liquid crystal panel, so that the result of the measurement of the luminance and chromaticity (colorimetry result) at that time is obtained from the colorimetric sensor 3. This processing is repeatedly carried out the number of times corresponding to steps or levels of the luminance of the backlight. In other words, the more the number of steps or levels of luminance, the more number of times the calibration processing will be carried out. The number of steps or levels of the luminance of the backlight is decided by the luminance level decision unit 20 based on a target value of a predetermined display characteristic (here, a contrast ratio) to be transmitted to the luminance level decision unit 20 in step S102. The number of levels of luminance and the luminance at each level (i.e., each level of luminance) at which the calibration processing is carried out are decided according to the target contrast ratio which has been set by the user in steps S105 and S106.

In step S109, the color chart measurement control unit 27 carries out calibration for the i-th level (i=1 through N) of luminance of the backlight. The color chart measurement control unit 27 outputs a backlight driving signal for obtaining a maximum luminance in a range of display luminance corresponding to the i-th level (i=1 through N) of luminance of the backlight to the backlight driving signal decision unit 11 of the display 1 through the display control cable 5. As a result of this, the backlight emits light at the i-th level of luminance. Moreover, the color chart measurement control unit 27 carries out the control to display a predetermined plurality of color charts on the screen of the display 1 in a sequential manner by means of the screen drawing unit 23, so that the measurement data (colorimetric values) of luminance and chromaticity measured by the colorimetric sensor 3 are obtained, respectively. The color charts to be displayed are a gray color chart with a predetermined number of gray levels, a color chart of three primary colors of red, green and blue, etc.

The calibration data decision unit 28 compares, for each color chart, the measurement values of the luminance and the chromaticity of each color chart which have been displayed by the use of the arithmetic operation parameters and the look-up tables before calibration and measured by the colorimetric sensor 3, with the luminance and the chromaticity of each color chart which should be displayed. The calibration data decision unit 28 carries out the calibration of the display 1 by adjusting arithmetic operation parameters or the values of the look-up tables so that errors between both the compared values become smaller.

The calibration data decision unit 28 transmits the result of the calibration, i.e., the arithmetic operation parameters and the data of the look-up tables thus adjusted as referred to above, to the calibration data storage unit 18 of the display 1 through the display control cable 5. The calibration data storage unit 18 obtains the calibration result from the calibration data decision unit 28, and stores the luminance at each level for which calibration has been carried out and the result of the calibration, while correlating them with each other.

In step S112, the calibration data decision unit 28 generates a monitor profile based on the above-mentioned calibration data, and stores it in the profile storage unit 29. The monitor profile is referred to at the time when the screen drawing unit 23 carries out color management processing. Now, reference will be made to the processing (steps S101 through S107 in FIG. 2) in which the luminance level decision unit 20 decides the level of luminance of the backlight to be calibrated based on the calibration target values set by the user. In this embodiment, based on a target value of the contrast ratio (target contrast ratio), the luminance level decision unit 20 decides the number of levels of change-over of the luminance of the backlight and the luminance at each level thereof which are required in order to adjust the contrast ratio to the target value thereof. The setting of the target values may be carried out by the setting of the target value of the contrast ratio, or may be carried out by the setting of the target values of one or more display characteristics (e.g., white color luminance and black color luminance) which can calculate the contrast ratio. Here is shown the example in which the decision of the number of levels of the change-over of the luminance and the decision of the luminance at each level according to the local dimming control are made based on the target value of the contrast ratio, but the number of levels of the change-over of the luminance and the luminance at each level may be decided based on the target values of other display characteristics.

FIGS. 3A through 3C are views showing examples of the calibration target value setting screen. The user can set the target values for calibration through the calibration target value setting screens shown in FIGS. 3A through 3C. White color luminance is set by a numerical value (cd/m$^2$) at a box 31. The setting value of the white color luminance is clipped by a maximum luminance which can be displayed (i.e., a luminance at the time when the luminance of the backlight and the liquid crystal transmittance of all the pixels are made to be maximum). The information on the maximum displayable luminance has been stored in the target value effective range storage unit 21.

White chromaticity is set by color temperature at a box 32, or is set by xy chromaticity coordinates at boxes 33. The color temperature is set with a numerical value (K (kelvin)) or with a standard illuminant color temperature (e.g., D50, D65, etc.). In cases where the white chromaticity is set by color temperature, the xy chromaticity coordinate boxes 33 are filled in an automatic fashion. Black color luminance is set by a numerical value (cd/m$^2$) at a box 34. A minimum value of the black color luminance is clipped by a minimum luminance which can be displayed (i.e., a luminance at the time when the luminance of the backlight and the liquid crystal transmittance of all the pixels are made to be minimum). The information on the minimum displayable luminance has been stored in the target value effective range storage unit 21.

The contrast ratio is set by a numerical value at a box 35. A maximum value of the contrast ratio is clipped by the value of the above-mentioned maximum displayable luminance/the above-mentioned minimum displayable luminance. The information on the maximum value of the contrast ratio has been stored in the target value effective range storage unit 21. When either one of the black color luminance and the contrast ratio is set, the value of the other is calculated according to an equation "contrast ratio=white color luminance/black color luminance", and is inputted to a box at the other side in an automatic fashion.

A color gamut (chromaticities of three primary colors) is set by a color gamut name (sRGB, AdobeRGB (trademark), etc.) at a box 36, or is set by the xy chromaticity coordinates of each of three primary colors at boxes 37. In cases where the color gamut is set by a color gamut name, the individual xy chromaticity coordinate boxes 37 of the three primary colors are filled in an automatic fashion. On the calibration target value setting screen, it can be set whether local dimming is made valid or invalid. The validity or invalidity of local dimming can be switched or changed over by the click of a check box 39.

FIG. 3A shows a state where local dimming is valid or effective because the check box 39 is checked, and FIG. 3B shows a state where local dimming is invalid or ineffective because the check box 39 is not checked. FIG. 3C shows a state where the check box 39 is grayed out so that the change between the validity and invalidity of local dimming is not received. In FIG. 3C, the grayed-out representation of the check box 39 is shown by a broken line.

When local dimming is carried out, in cases where bright pixels and dark pixels exist in a mixed manner in the same divided display area, an original color may be displayed in a color which is different from a desired color. In cases where particular importance is placed on the accuracy of the color, the user can also select to make local dimming invalid (ineffective). However, when local dimming is made invalid, the target contrast ratio may not be obtained (i.e., the black color luminance becomes higher than a target black color luminance). Thus, in cases where local dimming is made invalid, the luminance level decision unit 20 sets the number of levels N of luminance of the backlight to 1 unconditionally.

Local dimming is unnecessary in cases where the target contrast ratio set by the user can be achieved with a single level of backlight luminance. In cases where it is judged from the target contrast ratio thus set or inputted that there is no need to carry out local dimming, the luminance level decision unit 20 sets the number of levels N of backlight luminance to 1. The luminance level decision unit 20 sets a flag indicating the necessity of local dimming to 0, which shows that local dimming is unnecessary, and sends it to the luminance level obtaining unit 26.

Local dimming is necessary in cases where the target contrast ratio set by the user can not be achieved with a single level of backlight luminance. In cases where it is judged from the target contrast ratio thus set or inputted that there is a need to carry out local dimming, the luminance level decision unit 20 calculates the number of levels N of backlight luminance as required. The luminance level decision unit 20 sets a flag indicating the necessity of local dimming to 1, which shows that local dimming is necessary, and sends it to the luminance level obtaining unit 26. A method of obtaining the required number of levels N of the backlight luminance will be described later. The luminance level decision unit 20 carries out luminance level transmission by transmitting the information on the number of levels N of the backlight luminance of and the range of display luminance in each level to the luminance level obtaining unit 26.

Here, note that even in cases where it is judged from the target value of the contrast ratio inputted that there is a need to carry out local dimming, when the user selects to make local dimming invalid, the luminance level decision unit 20 sets the number of levels N of luminance of the backlight to 1.

In cases where local dimming is unnecessary with reference to the above-mentioned necessity flag for local dimming, the target value setting unit 24 instructs the screen drawing unit 23 to carry out a grayed-out representation of the check box 39, as shown in FIG. 3C. On the other hand, in cases where local dimming is necessary with reference to the above-mentioned necessity flag for local dimming, the target value setting unit 24 instructs the screen drawing unit 23 to cancel or remove the grayed-out representation of the check box 39, as shown in FIG. 3A. As a result of this, it is made possible for the user to check or uncheck the check box 39.

Reference will be made to the processing (i.e., step S103 in FIG. 2) in which the luminance level decision unit 20 obtains the number of levels N of the change-over of the backlight luminance required in local dimming so as to adjust the contrast ratio of the display 1 to a set target value of the contrast ratio, while using FIG. 4 and FIGS. 5A through 5C.

FIG. 4 is a table showing an example of a correlation relation among the target contrast ratio, the number of levels of the change-over of the luminance of the backlight and the luminance at each level (display luminance range) required to achieve the target contrast ratio. Data for such a correlation relation have been prepared beforehand and stored in a second storage unit. The second storage unit may be constructed such that it is included in the luminance level decision unit 20, or may be separately provided as a component unit which is not shown in the display 1 of FIG. 1A. Here, the luminance of the backlight is decided by selecting one level of luminance from among a predetermined number of levels (here, five levels) of luminance. When the number of levels N is 1, the luminance of the backlight will be controlled to be a fixed luminance. In other words, local dimming control is not carried out. In FIG. 4, the display luminance range in each luminance level is expressed in terms of percentage with respect to a target white color luminance (maximum luminance). When the value of a percentage in FIG. 4 is multiplied by the target white color luminance, the display luminance range in each level of luminance of the backlight can be obtained in units of cd/m$^2$.

Based on the target contrast ratio transmitted from the target value transmission unit 25, the luminance level decision unit 20 obtains the number of levels N of the change-over of the backlight luminance and the display luminance range at each level, with reference to the table of FIG. 4. A contrast ratio, which can be achieved with a single level of backlight luminance (i.e., a ratio between a maximum luminance and a minimum luminance which can be achieved with the single level of backlight luminance), varies in accordance with the performance (specifications) of the display. The number of levels N of the change-over of the luminance of the backlight required to achieve the target contrast ratio varies according to the display even if the target contrast ratio thereof is the same.

The example shown in FIG. 4 is an example of a table which defines the correlation relation among the number of levels N of the change-over of the luminance of the backlight, the display luminance range at each level, and the range of the contrast ratio which can be displayed on the display 1 in cases where the luminance of the backlight is switched or changed over under the above luminance change-over condition. FIG. 4 shows the example of the display in which the contrast ratio thereof which can be achieved with the single level of backlight luminance is 1000:1. The range of a value, which can be taken by the contrast ratio of the display in cases where the backlight is caused to emit light at a luminance at each level among the number of levels, is decided by the number of levels N of the change-over of the luminance of the backlight. With reference to the table of FIG. 4, the luminance level decision unit 20 decides the luminance change condition (the number of change-over levels of the luminance and the luminance at each level) in which the target contrast ratio set by the user is included within the range of the value which can be taken by the contrast ratio of the display. In the case of this display, when the set target contrast ratio is 1000:1 or less, the luminance level decision unit 20 judges that local dimming is unnecessary, in order to achieve the target contrast ratio. Then, the luminance level decision unit 20 decides that the number of levels N of the change-over of the backlight luminance required to achieve the target contrast ratio is 1 (N=1).

On the other hand, when the set target contrast ratio is larger than 1000:1, the luminance level decision unit 20 judges that local dimming is necessary, in order to achieve the target contrast ratio. Then, the luminance level decision unit 20 decides that the number of levels N of the change-over of the backlight luminance required to achieve the target contrast ratio is larger than 1 (N>1).

In the example of FIG. 4, when the target contrast ratio is larger than 1000:1 and is equal to 2000:1 or less, the luminance level decision unit 20 decides that the number of levels N of the change-over of the backlight luminance is 3 (N=3). In addition, when the target contrast ratio is larger than 2000:1 and is equal to 4000:1 or less, the luminance level decision unit 20 decides that the number of levels N of the change-over of the backlight luminance is 5 (N=5). In the example of FIG. 4, the display luminance range of the backlight luminance at each level is 0.1%-100% for the first level, 0.07%-70% for the second level, 0.05%-50% for the third level, 0.035%-35% for the fourth level, and 0.025%-25% for the fifth level, respectively. Because a maximum luminance at the first level, which is the brightest, is 100% and a minimum luminance at the fifth level, which is the darkest, is 0.025%, it is possible to achieve a maximum contrast ratio of 4000:1 by setting the number of levels N of the change-over of the backlight luminance to (N=5). Here, note that in cases where the user sets the local dimming to an invalid or ineffective state, the local dimming is not carried out without regard to the target contrast ratio, and hence, the luminance level decision unit 20 sets the number of levels N of the change-over of the backlight luminance to 1 (N=1). Here, 0.1% at the first level corresponds to a state where a liquid crystal shutter is closed, and 100% at the first level corresponds to a state where the liquid crystal shutter is opened. The same is applied to the second and subsequent levels. Moreover, in this embodiment, no mention has been made to a case where the luminance of the backlight is set to zero, but the construction may also include such a case, i.e., the backlight luminance being set to zero (the backlight being completely turned off). In that case, the number of levels of the change-over of the backlight becomes two at the minimum, and six at the maximum.

FIGS. 5A through 5C are tables showing examples of the correlation relation among the target white color luminance, the target black color luminance and the target contrast ratio, which are set by the user, as well as the number of levels N of the change-over of the luminance of the backlight and the display luminance range at each level (cd/m$^2$) in the case of local dimming. Here, in this embodiment, it is assumed that even if it is possible for the display to achieve a contrast ratio of 4,000:1, the user may not always want to set the contrast ratio of the display to 4,000:1. For example, there may also be a case where the user wants to adjust the display to match the print image quality of a printer (i.e., to match the black level of the display to the black level of ink), rather than placing emphasis on the contrast ratio. In addition, if it is the case where a comparison is made between a displayed image of a projector and a displayed image of the display, there will also be a case where the user wants to match the contrast ratio of the display to the contrast ratio of the projector. Moreover, there can also be a case where a user who does not like local dimming control wants to set local dimming to an "invalid" state. Further, there are some users who attach greater importance to low consumption power than to contrast ratio. FIG. 5A is an example in which a comparison is made between cases where white color luminances, white chromaticities, color gamuts, and gamma coefficients are the same, but black color luminances are different (i.e., contrast ratios are different), wherein the number of levels N of the change-over of backlight luminance increases in accordance with the increasing contrast ratio. FIG. 5B is an example in which a comparison is made between cases where contrast ratios, white chromaticities, color gamuts, and gamma coefficients are the same, but white color luminances are different (i.e., black color luminances are different), wherein the display luminance at each level becomes higher in proportion as white color luminance becomes higher. FIG. 5C is an example in which a comparison is made between cases where black color luminances, white chromaticities, color gamuts, and gamma coefficients are the same, but white color luminances are different (i.e., contrast ratios are different), wherein the number of levels N of the change-over of backlight luminance increases in accordance with the increasing contrast ratio.

The luminance level decision unit 20 refers to the calibration target value boxes of FIGS. 5A through 5C based on the calibration target values received from the target value transmission unit 25. The luminance level decision unit 20 obtains the number of levels N of the change-over of the backlight luminance and the display luminance range at each level in the local dimming required for achieving these calibration target values thus received. The luminance level decision unit 20 outputs these values thus obtained to the luminance level obtaining unit 26 (however, in the case where the user sets local dimming to its valid state). The luminance level obtaining unit 26 passes to the color chart measurement control unit 27 the information on the number of levels N of the change-over of the luminance of the backlight and the display luminance range at each level obtained from the luminance level decision unit 20. The color chart measurement control unit 27 carries out calibration control on the luminance at each level obtained from the luminance level obtaining unit 26.

Thus, in the system of this embodiment, the number of levels of the luminance of the backlight at which the color chart measurement control unit 27 carries out measurements of the display luminance and the display chromaticity of each color chart is limited to a number of levels which is judged to be necessary in order to achieve the target contrast ratio set by the user. In other words, the calibration is not carried out on the levels of the luminance of the backlight which are unnecessary in order to achieve the set target contrast ratio.

For example, in the examples of FIG. 4 and FIGS. 5A through 5C, when the set target contrast ratio is 4000:1, the calibration will be carried out on each of the five levels of the backlight luminance. On the other hand, when the set target contrast ratio is 1000:1, the calibration will only be carried out on the one level of the backlight luminance. In this respect, in the conventional techniques, the calibration would be carried out on all of the five levels of the backlight luminance without regard to the set target contrast ratio, so there have been cases where the execution time of the calibration may become unnecessarily long. According to this embodiment, the calibration is carried out only on an appropriate number of levels of the luminance of the backlight according to the target contrast ratio, and hence, it is possible to suppress the number of times of calibration required, thus making it possible to carry out the calibration in an effective manner.

Figure 6:
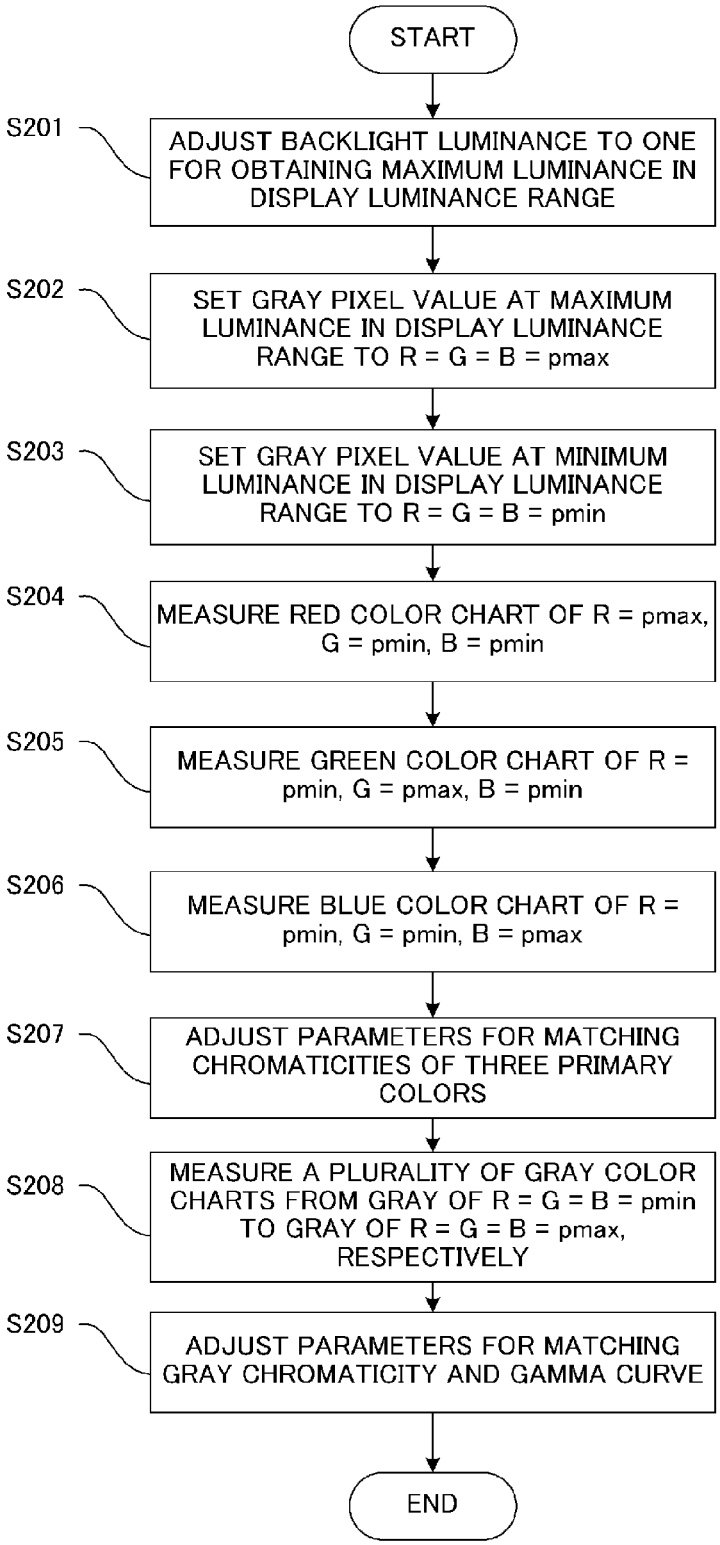
FIG. 6 is a flow chart showing calibration processing in the first embodiment of the present invention.

Now, reference will be made to an example of the calibration processing (step S109 in FIG. 2) which is carried out on a certain level of backlight luminance, while using a flow chart in FIG. 6. Here, according to that level of luminance at which the calibration is carried out, the color chart measurement control unit 27 outputs an instruction for driving the backlight 13 to the display 1, and at the same time outputs an instruction for displaying a predetermined color chart to the liquid crystal cell 16, whereby it obtains measurement data of the luminance and chromaticity measured by the colorimetric sensor 3 at that time. Based on the measurement data, the calibration data decision unit 28 carries out the calibration of arithmetic operation parameters and the look-up tables. Here, note that there is no need to display the color chart on an entire area of the display, but instead just to display it on a partial area of the display. In addition, at the time of the execution of the calibration, the entire backlight may be turned on, or only a part of the backlight corresponding to an area containing the displayed area of the color chart may be turned on.

Here, it is assumed that a display luminance range corresponding to the level of luminance of the backlight at which the calibration is carried out is Ymin–Ymax. In step S201, the color chart measurement control unit 27 adjusts the backlight driving signal in such a manner that the backlight luminance becomes appropriate for obtaining a maximum luminance Ymax in that display luminance range. The color chart measurement control unit 27 outputs an instruction to the display 1 so that the backlight 13 can be driven at a drive current value and a pulse width modulation duty ratio which correspond to the level of luminance of the backlight at which the calibration is carried out.

In step S202, the color chart measurement control unit 27 calculates a gray pixel value (R=G=B=pmax) of the maximum luminance Ymax in the display luminance range concerned. In step S203, the color chart measurement control unit 27 calculates a gray pixel value (R=G=B=pmin) of a minimum luminance Ymin in the display luminance range concerned. A calculation method for pmax and pmin will be described below. When the target white color luminance is denoted by Yw, the target black color luminance by Yk and the target gamma coefficient by γ, the display luminance Y of a gray (R=G=B=p) is obtained according to the following equation 1.

$$Y=((p/255)^{\gamma})*(Yw-Yk)+Yk \quad \text{Equation 1}$$

Accordingly, pmax and pmin are obtained by solving the following individual equations 2 and 3 with respect to pmax and pmin, respectively.

$$Y\max=((p\max/255)^{\gamma})*(Yw-Yk)+Yk \quad \text{Equation 2}$$

$$Y\min=((p\min/255)^{\gamma})*(Yw-Yk)+Yk \quad \text{Equation 3}$$

For example, it is assumed that the target white color luminance Yw, the target black color luminance Yk and the target gamma coefficient γ are respectively set as follows: Yw=400 cd/m$^2$, Yk=0.1 cd/m$^2$, and γ=2.2. In this case, in the third level of backlight luminance (0.05%-50% with respect to white color luminance) in FIG. 4, Ymin and Ymax become as follows: Ymin=0.2 cd/m$^2$, and Ymax=200 cd/m$^2$. Accordingly, pmax and pmin are calculated as pmax=186 and pmin=6.

In step S204, the color chart measurement control unit 27 carries out the control to measure the luminance and chromaticity of a red color chart of R=pmax, G=pmin, and B=pmin by means of the colorimetric sensor 3. In step S205, the color chart measurement control unit 27 carries out the control to measure the luminance and chromaticity of a green color chart of R=pmin, G=pmax, and B=pmin by means of the colorimetric sensor 3. In step S206, the color chart measurement control unit 27 carries out the control to measure the luminance and chromaticity of a blue color chart of R=pmin, G=pmin, and B=pmax by means of the colorimetric sensor 3.

In step S207, the calibration data decision unit 28 adjusts parameters (parameters related to driving the backlight and the liquid crystal) for matching the chromaticities of three primary colors to the hues of the target values of the three primary color chromaticities. By adjusting the parameters concerned, the backlight driving signal and the liquid crystal driving signal can be adjusted. In step S208, the color chart measurement control unit 27 carries out the control to measure a plurality of gray color charts ranging from the gray of R=G=B=pmin to the gray of R=G=B=pmax, respectively, by means of the colorimetric sensor 3.

In step S209, the calibration data decision unit 28 adjusts, for each of the grays measured as referred to above, the parameters for adjusting the chromaticities and gamma curves thereof so as to match the target values of the white chromaticities and the target values of the gamma curves, respectively. By adjusting the parameters concerned, the backlight driving signal and the liquid crystal driving signal can be adjusted. The calibration data decision unit 28 adjusts the parameters for the calculation of the liquid crystal driving signal, so that when p takes each value from pmin to pmax, in the concerned level of the backlight luminance, the liquid crystal driving signal becomes such that the display luminance Y satisfies the equation 1. By adjusting the parameters for the calculation of the liquid crystal driving signal so as to satisfy the equation 1 in the individual levels of backlight luminance, respectively, the gray of R=G=B=p becomes the same display luminance even at any level of backlight luminance.

Figure 1B:
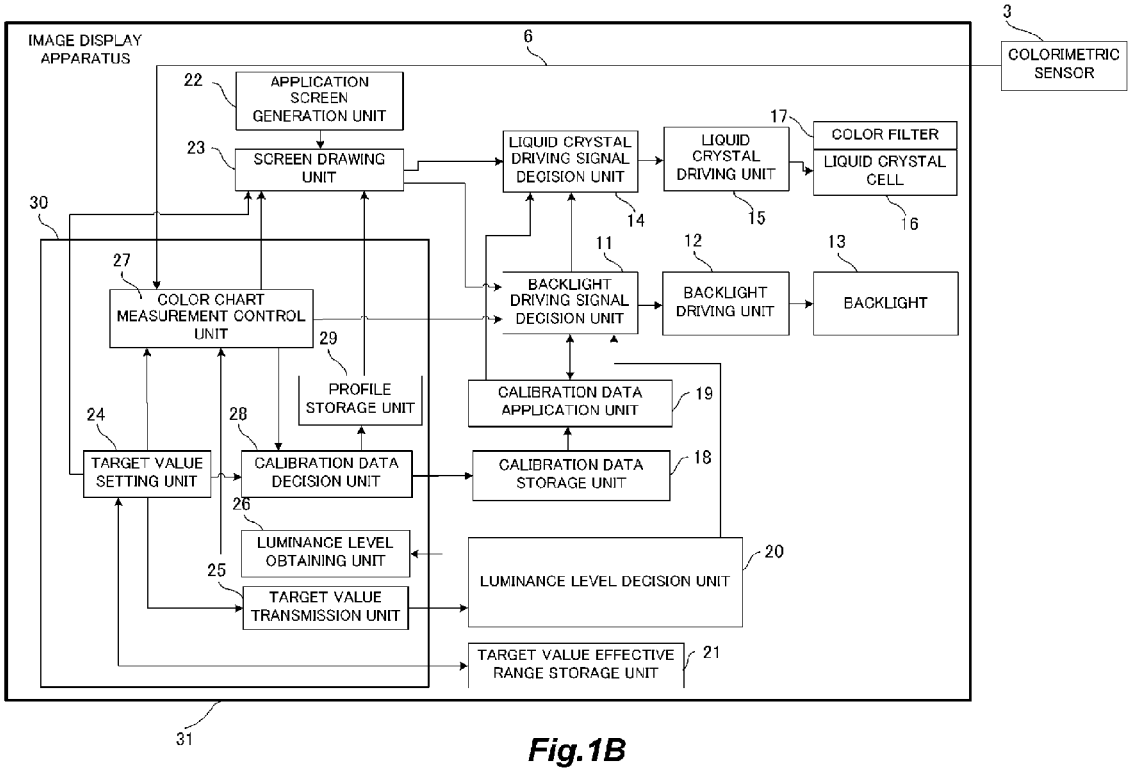

Here, note that this embodiment can be modified in a manner as described below, for example. FIG. 1A shows an example of the image display system in which the display 1, the computer 2, and the colorimetric sensor 3 are constructed separately from one another. However, the construction may be such that a calibration control program, which serves to execute the function of the above-mentioned calibration control unit 30, is installed on the display 1. That is, it may be constructed such that the computer 2 is built in the display 1. A block diagram in this case is shown in FIG. 1B. An image display apparatus 31 in FIG. 1B shows such a construction in which the computer 2 of FIG. 1A is built in the display 1. In addition, a second computer, which is provided with a function unit corresponding to the application screen generation unit 22 and the screen drawing unit 23 in FIG. 1A, may be connected to the display 1 through the image signal cable 4, so that an application screen of the second computer can be displayed on the display 1. Moreover, it may be constructed such that the colorimetric sensor 3 is built in the display 1. Further, although FIG. 1A shows a construction example in which the image signal cable 4 and the display control cable 5 are constructed of separate and independent cables, respectively, an image signal and a display control signal may be multiplexed on one and the same cable.

In the description of FIGS. 1A and 1B, a pixel value is represented by a value of 256 steps or levels (eight bits for each color component), with respect to a R (red) component, a G (green) component, and a B (blue) component, respectively, but the invention is not limited to this. For example, a pixel value may be represented by a value of 1,024 steps or levels (10 bits for each color component), or by a value of 4,096 steps or levels (12 bits for each color component). For example, in the case of 1,024 levels (10 bits for each color component), the value of 255 in the equation 1, the equation 2, and the equation 3 is replaced with 1,023 (a maximum value for 10-bit unsigned integers), respectively. For example, in the case of 4,095 levels (12 bits for each color component), the value of 255 in the equation 1, the equation 2, and the equation is replaced with 4,095 (a maximum value for 12-bit unsigned integers), respectively.

In the description of FIGS. 1A and 1B, the display 1 is provided with the local dimming function, wherein the backlight 13 is divided into a plurality of light source blocks, so that the level of luminance of the backlight is controlled to be switched or changed over for each light source block. However, the display 1 may be made to carry out the dimming control to switch or change over the level of the luminance of the entire backlight 13 according to the brightness of an image signal to be inputted, without dividing the backlight 13 (i.e., the number of divisions of light source blocks is 1).

Although in FIGS. 5A through 5C, the display luminance range corresponding to each level of backlight luminance is represented by luminance in units of cd/m$^2$, it may be expressed, for example, by a relative value in units of percentage with respect to a target white color luminance which is set as 100%. In this case, the relative value, which is obtained by the luminance level obtaining unit 26, can be converted into a corresponding luminance value in units of cd/m$^2$, by being multiplied by the target white color luminance. The relative value may be represented not only by percentage, but also, for example, by a value of 0-255 (in this case, the target white color luminance is set to 255). In addition, the flow chart of FIG. 6 is an example of the most basic calibration, and in order to further enhance accuracy, measurement of color charts may also be added, or adjustment of the parameters may also be added.

As described above, in this first embodiment, the need to carry out local dimming control and the number of change-over steps or levels of the luminance according to the local dimming control are judged or determined from a target contrast ratio, or a target white color luminance and a target black color luminance set by the user. In cases where it is judged that there is no need to carry out local dimming control or that there is a need to carry out local dimming control, but the number of change-over steps or levels of the luminance required can be small, the calibration at the levels of luminance which are not used is not carried out. Accordingly, the calibration is carried out at a number of times required by or according to the number of change-over levels of the luminance of the backlight which is decided based on the target value of the contrast ratio set by the user. As a result, the calibration can be carried out in an efficient manner.

(Second Embodiment)

At the time of deciding the number of levels N of the change-over of the backlight luminance, the luminance level decision unit 20 in FIGS. 1A and 1B refers to the data beforehand stored of the contrast ratio which can be achieved with a single level of backlight luminance, and compares the target contrast ratio set by the user with the data thus referred to. The luminance level decision unit 20 makes a judgement such that when the set target contrast ratio can be achieved with the single level of backlight luminance, local dimming is not carried out, but when it can not be achieved, local dimming is carried out at the number of change-over levels of luminance decided according to the target contrast ratio.

However, the contrast ratio which can be achieved with the single level of backlight luminance may vary depending upon the target value of the white chromaticity. For example, when a comparison is made between the case where the target value of white chromaticity (color temperature) is D50 (about 5,003 K) and the case where it is D65 (about 6,504 K), the contrast ratio becomes lower in the case of D50 than in the case of D65. This is because the balance among the liquid crystal transmittances of R, G, and B in the black display is adjusted so as to match the black chromaticity to the white chromaticity, so that the black color luminance becomes higher. The difference between the original black chromaticity and the white chromaticity is larger in the case of D50 than in the case of D65, so it is necessary to make the black color luminance higher in the case of D50. In addition, the contrast ratio which can be achieved with the single level of backlight luminance may vary due to a change over time or aging.

Accordingly, in this second embodiment, the contrast ratio which can be achieved by the single level of backlight luminance is actually measured based on the set calibration target values. The luminance level decision unit 20 judges or decides based on the result of the measurement thus obtained whether the target contrast ratio set by the user can be achieved with the single level of backlight luminance (i.e., whether it is necessary to carry out local dimming).

Reference will be made to the processing at the time when the image display system of the second embodiment carries out calibration, while using a flow chart of FIG. 7 and an example of a calibration target value setting screen of FIGS. 8A and 8B. The calibration target value setting screen of FIGS. 8A and 8B is similar to the calibration target value setting screen of FIGS. 3A through 3C described in the first embodiment, but further includes the addition of a button 42 by which a user can input an execution instruction for contrast ratio measurement, and a box 43 which shows the result of measurement of the contrast ratio. The other GUI parts are the same as those in FIGS. 3A through 3C, so the explanation thereof is omitted.

Figure 2:
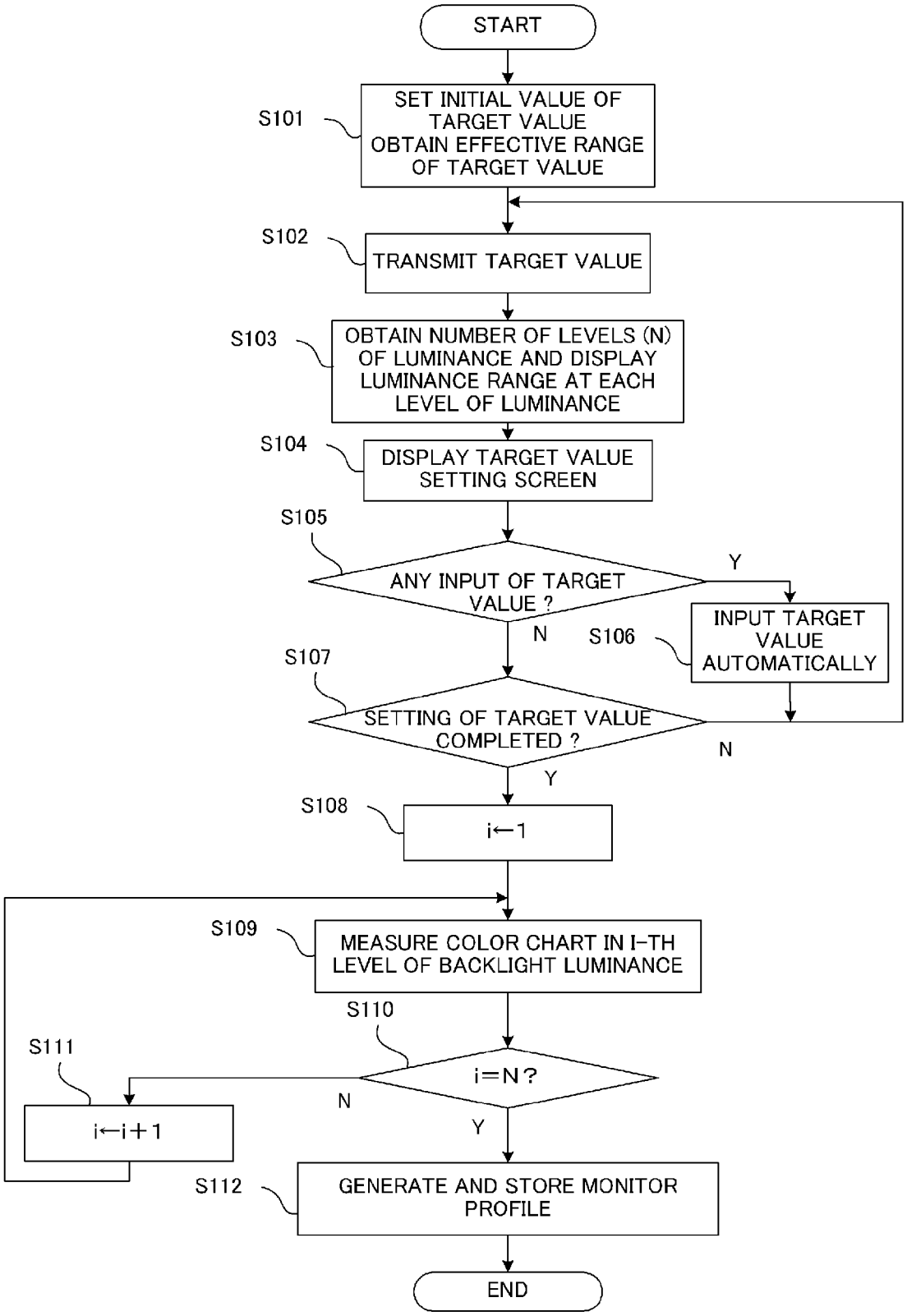
FIG. 2 is a flow chart showing calibration processing in the first embodiment of the present invention.
Figure 7:
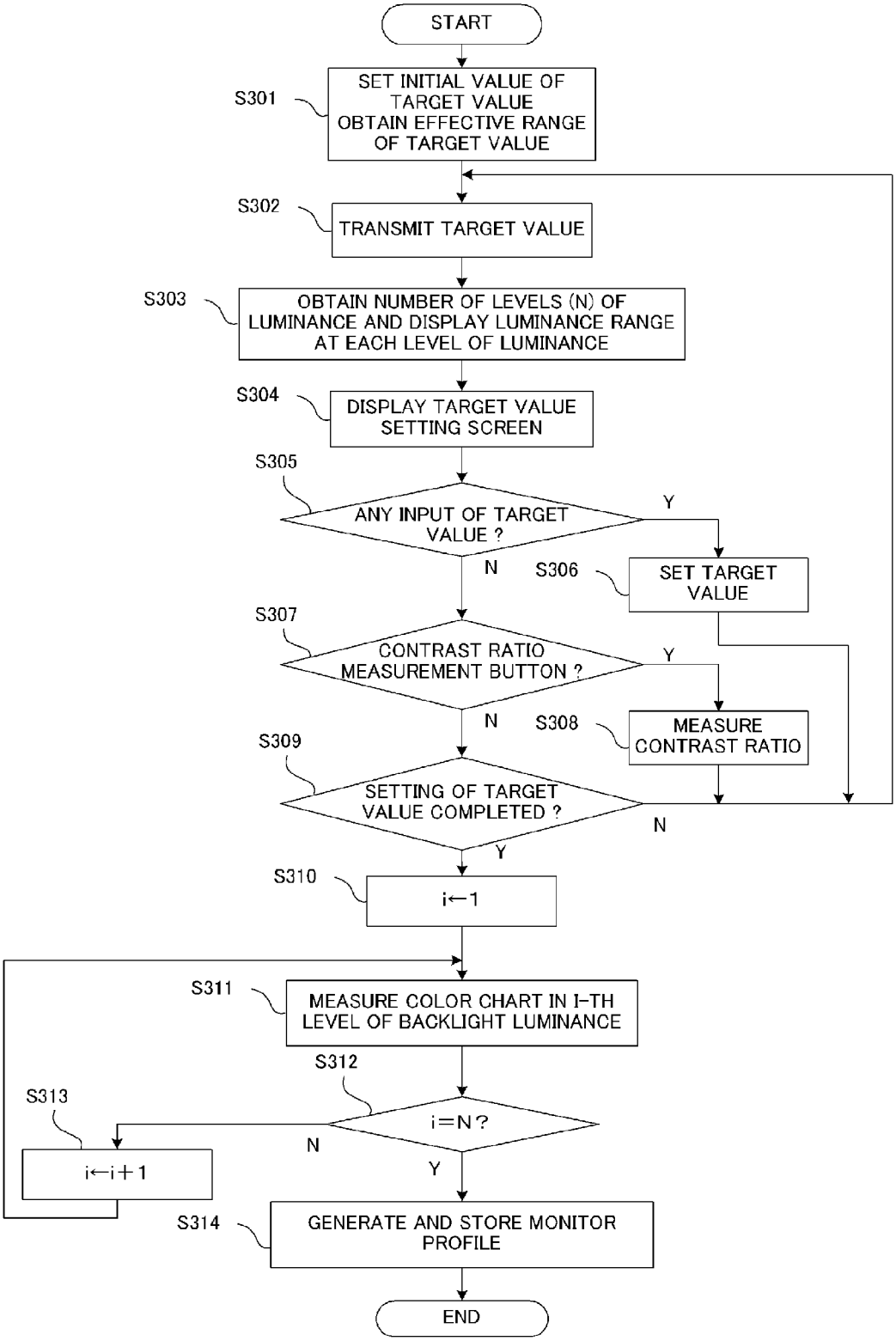
FIG. 7 is a flow chart showing calibration processing in a second embodiment of the present invention.
Figure 8A:
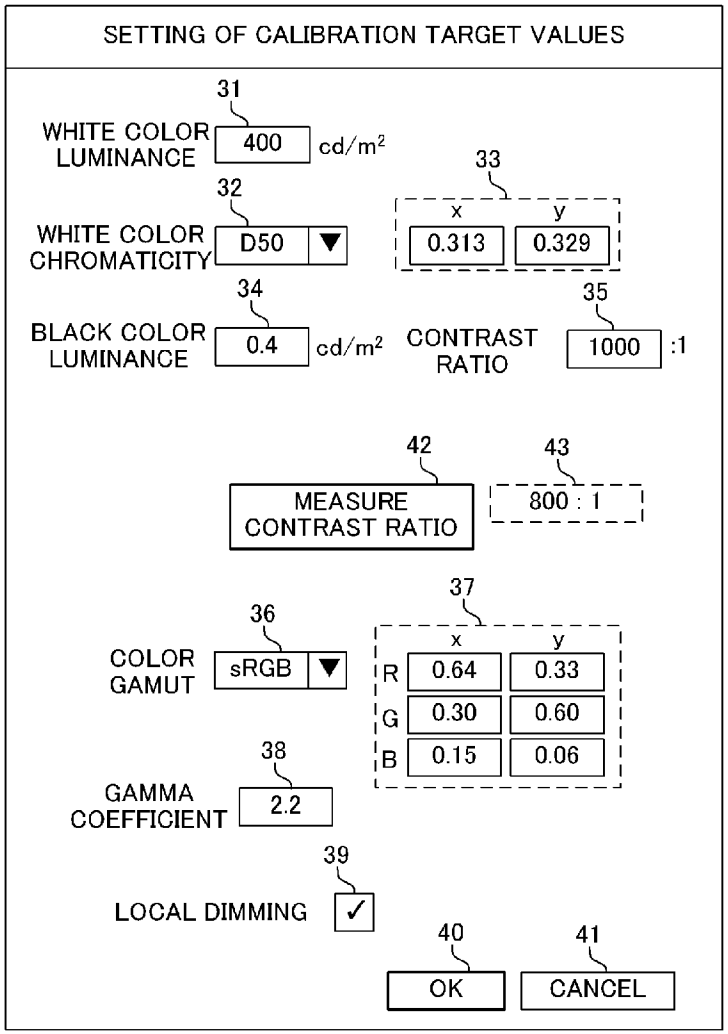
FIGS. 8A and 8B are examples of a target value setting screen in the second embodiment of the present invention.
Figure 8B:
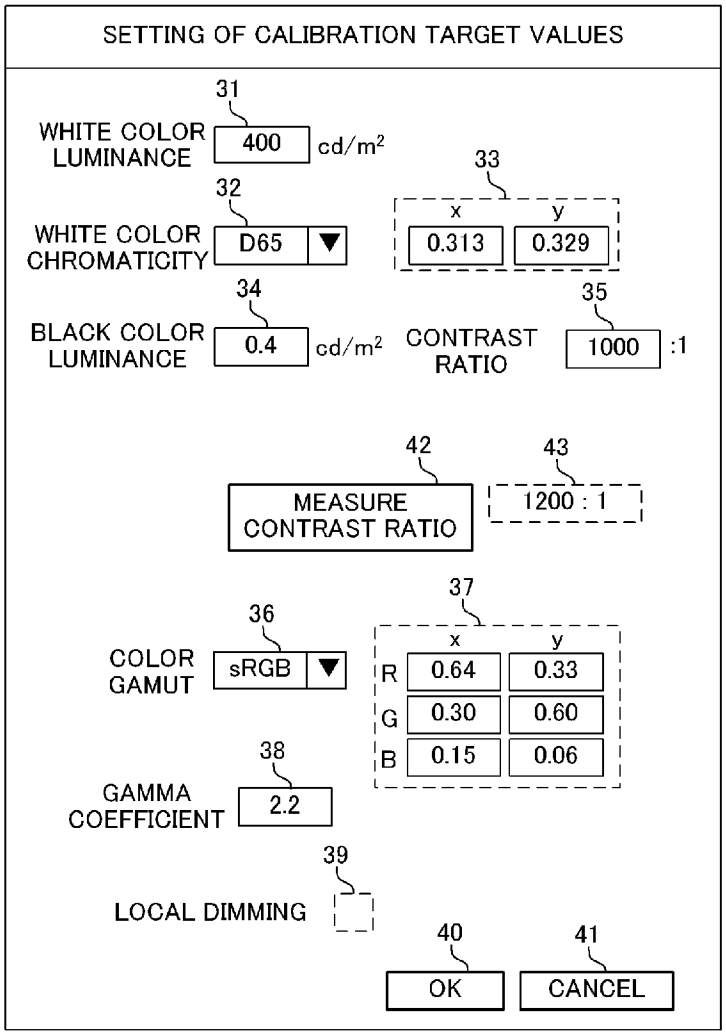

The flow chart of FIG. 7 is similar to the flow chart of FIG. 2, with the addition of processing of step S307 and processing of step S308. The processing of step S301 through step S306 is the same as that of step S101 through step S106 of FIG. 2, and the processing of step S309 through step S314 is the same as the processing of step S107 through step S112 of FIG. 2, so the description of these steps are omitted.

In step S307, when it is detected that the contrast ratio measurement button 42 in FIGS. 8A and 8B has been clicked, the target value setting unit 24 goes to step S308. In step S308, the color chart measurement control unit 27 obtains an actual contrast ratio by carrying out the control to make a predetermined color chart to be displayed and to measure the luminance and chromaticity thereof, in order to measure the contrast ratio which can be achieved with the single level of backlight luminance under the set target values. The details thereof will be described later. Then, a return is made to step S302, where at the time of transmitting the latest target values to the luminance level decision unit 20, the target value transmission unit 25 transmits the value of the actual contrast ratio together therewith, if the actual contrast ratio has been measured in the above-mentioned step S308.

In step S303, the luminance level decision unit 20 decides the number of levels N of the change-over of the backlight luminance and the display luminance range at each level required to achieve the set target contrast ratio. In this case, if the range of the measured value of the contrast ratio measured in the above-mentioned step S308 is obtained, the luminance level decision unit 20 refers to that measured value of the contrast ratio. On the other hand, if the measured value of the contrast ratio is not obtained, the initial value of the contrast ratio at the time of factory shipment stored in the luminance level decision unit 20 is referred to. In step S304, at the time when the target value setting unit 24 displays the calibration target value setting screen, if the actual contrast ratio has been measured in the above-mentioned step S308, the measured value of the contrast ratio is displayed in the measured contrast ratio display box 43.

In cases where local dimming is unnecessary with reference to a flag indicating the necessity of local dimming, the target value setting unit 24 carries out a grayed-out representation of the check box 39 thereby to disable an input thereto, as shown in FIG. 8B. In FIG. 8B, the grayed-out representation of the check box 39 is shown by a broken line. On the other hand, in cases where local dimming is necessary with reference to the above-mentioned flag, the target value setting unit 24 cancels or removes the grayed-out representation of the check box 39, as shown in FIG. 8A, thereby enabling the user to input whether local dimming is made valid or invalid.

FIG. 8A shows that a maximum value in the range of the measured value of the contrast ratio is 800:1. Since the target contrast ratio set by the user is 1,000:1, it is judged that the target contrast ratio can not be achieved with the single level of backlight luminance. Accordingly, in order to achieve the target contrast ratio, local dimming is necessary, and the check box 39 can be checked or unchecked by the user so that the user can set the validity or invalidity of local dimming.

FIG. 8B shows that a maximum value in the range of the measured value of the contrast ratio is 1,200:1. Since the target contrast ratio set by the user is 1,000:1, it is judged that the target contrast ratio can be achieved with the single level of backlight luminance. Accordingly, in order to achieve the target contrast ratio, local dimming is unnecessary, and the check box 39 is grayed out.

Figure 9:
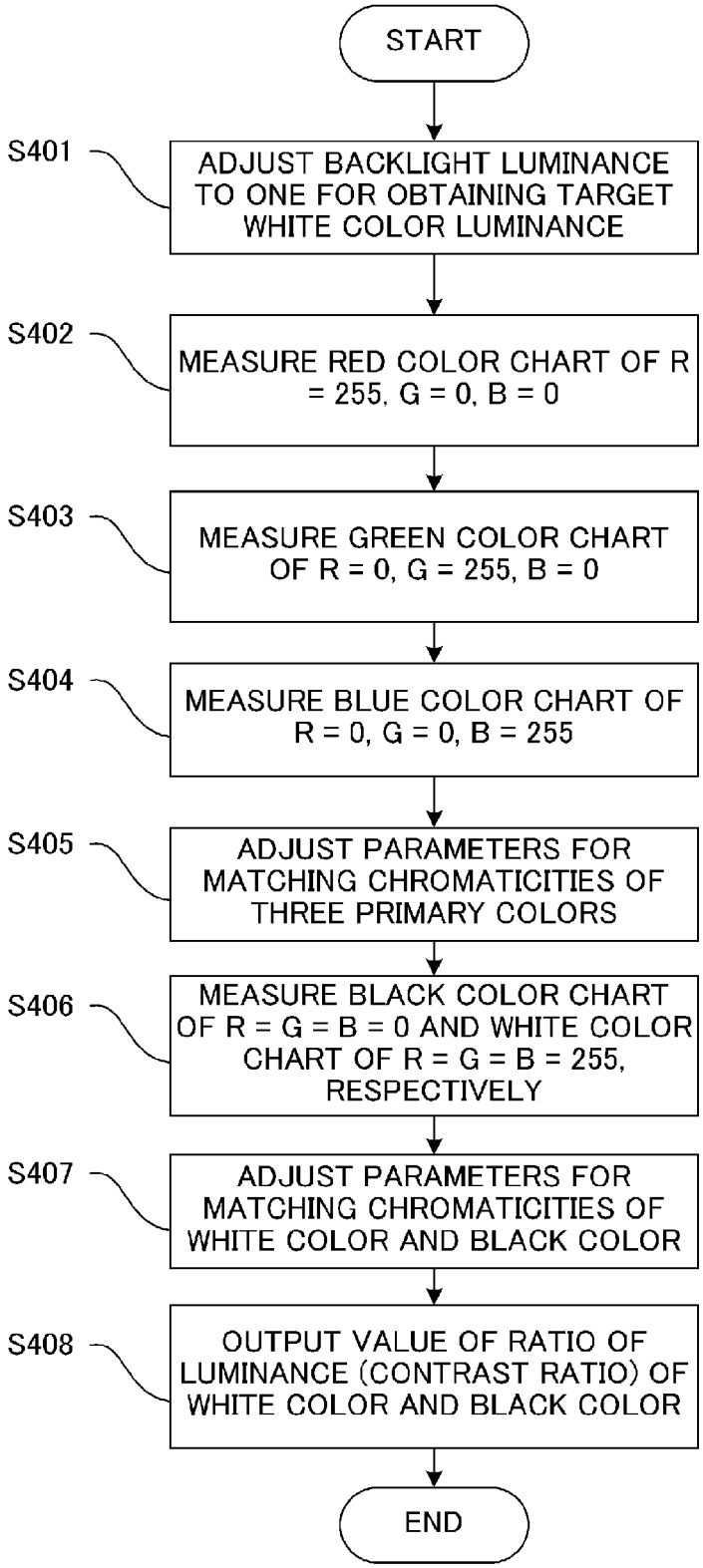
FIG. 9 is a flow chart showing contrast ratio measuring processing in the second embodiment of the present invention.

Now, reference will be made in detail to the processing (step S308 in FIG. 7) in which the color chart measurement control unit 27 measures the contrast ratio which can be achieved with the single level of backlight luminance under the set target value, while using a flow chart of FIG. 9. Here, it is assumed that a pixel value is represented, for example, by a value of 256 steps or levels (eight bits for each color component), with respect to a R (red) component, a G (green) component, and a B (blue) component, respectively. In step S401, the color chart measurement control unit 27 adjusts the backlight driving signal in such a manner that the backlight luminance becomes appropriate for obtaining a target white color luminance. The color chart measurement control unit 27 decides the drive current value and the pulse width modulation duty ratio in such a manner as to make the backlight luminance become a maximum, and gives an instruction for driving the backlight 13 to the display 1.

In step S402, the color chart measurement control unit 27 carries out the control to measure the luminance and chromaticity of a red color chart of R=255, G=0, and B=0 by means of the colorimetric sensor 3. In step S403, the color chart measurement control unit 27 carries out the control to measure the luminance and chromaticity of a green color chart of R=0, G=255, and B=0 by means of the colorimetric sensor 3. In step S404, the color chart measurement control unit 27 carries out the control to measure the luminance and chromaticity of a blue color chart of R=0, G=0, and B=255 by means of the colorimetric sensor 3.

In step S405, the calibration data decision unit 28 adjusts parameters for matching the chromaticities of three primary colors to the hues of the target values of the three primary color chromaticities. By adjusting the parameters concerned, the backlight driving signal and the liquid crystal driving signal can be adjusted. In step S406, the color chart measurement control unit 27 carries out the control to measure a black color chart of R=G=B=0 and a white color chart of R=G=B=255, respectively, by means of the colorimetric sensor 3.

In step S407, the calibration data decision unit 28 adjusts parameters for matching the chromaticities of white color and black color thus measured to the target values thereof. By adjusting the parameters concerned, the backlight driving signal and the liquid crystal driving signal can be adjusted. In step S408, the color chart measurement control unit 27 outputs the value (measured value) of a luminance ratio (contrast ratio) of white color and black color in a state where the above-mentioned adjustments of the backlight driving signal and the liquid crystal driving signal have been made.

In this processing, the measured values of the white color luminance and the black color luminance in the case of carrying out the calibration for matching the color gamut and the white chromaticity (color temperature) to the set target values thereof, respectively, insteps S405 and S407 are obtained. From these measured values, it is possible to obtain the measured value of the contrast ratio which can be achieved by the single level of backlight luminance under the condition of the set calibration target values (color gamut and color temperature). Accordingly, even in case where the value of the contrast ratio which can be achieved with the single level of backlight luminance is not constant due to the color gamut, color temperature, aged deterioration, etc., it is possible to decide an appropriate number of levels of the backlight luminance based on the set target contrast ratio. Thus, in the image display apparatus in which local dimming is carried out, the number of times or frequency of the calibration to be carried out can be reduced to a necessity minimum.

Although in the above-mentioned embodiments, reference has been made to the example in which the measured value of the contrast ratio achieved by the luminance of the single level is obtained, the luminance change-over condition in which the actual contrast ratio is obtained is similarly not limited to N=1. The measurement of the actual contrast ratio may be made for each number of levels. According to this, the setting of the color gamut and color temperature and/or the state of aged deterioration of the current backlight can be made to reflect on the correlation relation between the luminance change-over condition and the range of the contrast ratio which can be displayed in cases where the luminance of the backlight is changed under that condition.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-113961, filed on May 20, 2011, and Japanese Patent Application No. 2012-049238, filed on Mar. 6, 2012, which are hereby incorporated by reference herein in their entirety.

What is claimed is:

1. An image display apparatus having a display panel, and a backlight adapted to be changed over among a plurality of levels of luminance, said apparatus comprising:

a setting unit that sets a target value for a predetermined display characteristic of said image display apparatus;

a decision unit that decides, based on a continuous range of contrast ratios determined by said target value, a discrete number of levels of change-over of the luminance of said backlight; and a calibration unit that carries out color measurement by causing said backlight to emit light at each level of luminance decided by said decision unit and causing said image display apparatus to display a predetermined color chart thereon at each level of luminance of said backlight, and carries out calibration at each level of luminance of said backlight based on a color value measured by the color measurement, the color measurement and the calibration being repeatedly carried out the number of times corresponding to the number of levels of the luminance of said backlight decided by said decision unit.

2. The image display apparatus as set forth in claim 1, further comprising:

a storage unit that stores each level of luminance decided by said decision unit, and a result of the calibration for each level of luminance carried out by said calibration unit, while correlating each level of luminance thus decided and the calibration result thereof with each other.

3. The image display apparatus as set forth in claim 2, further comprising:

a luminance control unit that selects one level of luminance among the number of levels of luminance decided by said decision unit according to an image signal to be inputted, and changes over the luminance of said backlight to the selected level of luminance; and a driving unit that drives said backlight and said display panel based on a calibration result correlated with the level of luminance selected by said luminance control unit.

4. The image display apparatus as set forth in claim 3, wherein said backlight is divided into a plurality of light source blocks which can be changed over in luminance independently of one another, and said luminance control unit changes over the level of luminance of said backlight for each light source block according to the image signal in an area corresponding to each light source block, and said driving unit drives each light source block and said display panel in an area corresponding to each light source block based on the calibration result correlated with the level of luminance of each light source block.

5. The image display apparatus as set forth in claim 1, further comprising:

a second storage unit that stores a correlation relation among the number of levels of change-over of the luminance of said backlight and a range of contrast ratios which can be displayed on said image display apparatus in cases where the luminance of said backlight is changed over under the above luminance change-over condition;

wherein said setting unit sets a target value of the contrast ratio, or a target value(s) of one or more predetermined display characteristics from which a target value of the contrast ratio can be calculated; and said decision unit determines, based on the correlation relation stored in said second storage unit, a luminance change-over condition in which said set target value of the contrast ratio is contained within a range of the contrast ratios which can be displayed, and decides, based on the luminance change-over condition thus determined, the number of levels of change-over of the luminance of said backlight.

6. The image display apparatus as set forth in claim 5, further comprising:

an obtaining unit that obtains a measured value of the contrast ratio displayed on said image display apparatus in cases where the luminance of said backlight has been changed over under a predetermined luminance change-over condition;

wherein with respect to the luminance change-over condition under which the measured value of the contrast ratio has been obtained by said obtaining unit in the correlation relation stored in said second storage unit, said decision unit determines whether said set target value of the contrast ratio is contained within the range of the measured value of the contrast ratios thus obtained.

7. A calibration method for an image display apparatus having a display panel and a backlight adapted to be changed over among a plurality of levels of luminance, said method comprises:

a setting step to set a target value for a predetermined display characteristic of said image display apparatus;

a decision step to decide, based on a continuous range of contrast ratios determined by said target value, a discrete number of levels of change-over of the luminance of said backlight; and a calibration step to carry out color measurement by causing said backlight to emit light at each level of luminance decided in said decision step and causing said image display apparatus to display a predetermined color chart thereon at each level of luminance of said backlight, and to carry out calibration at each level of luminance of said backlight based on a color value measured by the color measurement, the color measurement and the calibration being repeatedly carried out the number of times corresponding to the number of levels of the luminance of said backlight decided by said decision unit.

8. The calibration method for an image display apparatus as set forth in claim 7, further comprising:

a storage step to store each level of luminance decided in said decision step, and a result of the calibration for each level of luminance carried out in said calibration step, while correlating each level of luminance thus decided and the calibration result thereof with each other.

9. The calibration method for an image display apparatus as set forth in claim 8, further comprising:

a luminance control step to select one level of luminance among the number of levels of luminance decided in said decision step according to an image signal to be inputted, and to change over the luminance of said backlight to the selected level of luminance; and a driving step to drive said backlight and said display panel based on a calibration result correlated with the level of luminance selected in said luminance control step.

10. The calibration method for an image display apparatus as set forth in claim 9, wherein said backlight is divided into a plurality of light source blocks which can be changed over in luminance independently of one another, and in said luminance control step, the level of luminance of said backlight for each light source block is changed over according to the image signal in an area corresponding to each light source block, and in said driving step, each light source block and said display panel in an area corresponding to each light source block are driven based on the calibration result correlated with the level of luminance of each light source block.

11. The calibration method for an image display apparatus as set forth in claim 7, further comprising:

a step to store in a second storage unit a correlation relation among the number of levels of change-over of the luminance of said backlight and a range of a contrast ratios which can be displayed on said image display apparatus in cases where the luminance of said backlight is changed over under the above luminance change-over condition;

wherein in said setting step, a target value of the contrast ratio is set, or a target value(s) of one or more predetermined display characteristics, from which a target value of the contrast ratio can be calculated, is set; and in said decision step, a luminance change-over condition in which said set target value of the contrast ratio is contained within a range of the contrast ratios which can be displayed is determined based on the correlation relation stored in said second storage unit, and the number of levels of change-over of the luminance of said backlight is decided based on the luminance change-over condition thus determined.

12. The calibration method for an image display apparatus as set forth in claim 11, further comprising:

an obtaining step to obtain a measured value of the contrast ratio displayed on said image display apparatus in cases where the luminance of said backlight has been changed over under a predetermined luminance change-over condition;

wherein in said decision step, with respect to the luminance change-over condition under which the measured value of the contrast ratio has been obtained in said obtaining step, in the correlation relation stored in said second storage unit, it is determined whether said set target value of the contrast ratio is contained within the range of the measured value of the contrast ratios thus obtained.

13. A non-transitory computer readable recording medium which stores therein a program for causing a computer to execute each step of said calibration method as set forth in claim 7.

14. An image display system which is provided with an image display apparatus having a display panel and a backlight adapted to be changed over among a plurality of levels of luminance, and a calibration device that carries out color measurement by causing said image display apparatus to display a predetermined color chart thereon, and carries out calibration of said image display apparatus based on a color value thus measured, wherein said calibration device comprises:

a setting unit that sets a target value for a predetermined display characteristic of said image display apparatus;

a target value transmission unit that transmits said target value to said image display apparatus;

a luminance level obtaining unit that obtains, from said image display apparatus, information on the number of levels of change-over of the luminance of said backlight decided based on said target value; and a calibration unit that carries out color measurement by causing said backlight to emit light at each level of the luminance obtained by said luminance level obtaining unit and causing said image display apparatus to display a predetermined color chart thereon at each level of luminance of said backlight, and carries out calibration at each level of the luminance of said backlight based on a color value measured by the color measurement, the color measurement and the calibration being repeatedly carried out the number of times corresponding to the number of levels of the luminance of said backlight obtained by said luminance level obtaining unit;

wherein said image display apparatus comprises:

a target value obtaining unit that obtains said target value for the predetermined display characteristic from said calibration device;

a decision unit that decides, based on a continuous range of contrast ratios determined by said target value, a discrete number of levels of change-over of the luminance of said backlight; and a luminance level transmission unit that transmits information on said number of levels decided by said decision unit to said calibration device.

15. The image display system as set forth in claim 14, wherein said image display apparatus comprises:

a calibration result obtaining unit that obtains from said calibration device a result of the calibration carried out by said calibration device for each level of luminance decided by said decision unit; and a storage unit that stores each level of luminance decided by said decision unit, and the result of the calibration for each level of luminance obtained by said calibration result obtaining unit, while correlating each level of luminance thus decided and the calibration result thereof with each other.

16. The image display system as set forth in claim 15, wherein said image display apparatus comprises:

a luminance control unit that selects one level of luminance among the number of levels of luminance decided by said decision unit according to an image signal to be inputted, and changes over the luminance of said backlight to the selected level of luminance; and a driving unit that drives said backlight and said display panel based on a calibration result correlated with the level of luminance selected by said luminance control unit.

17. The image display system as set forth in claim 16, wherein said backlight is divided into a plurality of light source blocks which can be changed over in luminance independently of one another, and said luminance control unit changes over the level of luminance of said backlight for each light source block according to the image signal in an area corresponding to each light source block, and said driving unit drives each light source block and said display panel in an area corresponding to each light source block based on the calibration result correlated with the level of luminance of each light source block.

18. The image display system as set forth in claim 14, wherein said image display apparatus comprises:

a second storage unit that stores a correlation relation among the number of levels of change-over of the luminance of said backlight and a range of a contrast ratios which can be displayed on said image display apparatus in cases where the luminance of said backlight is changed over under the above luminance change-over condition;

wherein said setting unit sets a target value of the contrast ratio, or a target value(s) of one or more predetermined display characteristics from which a target value of the contrast ratio can be calculated;

said target value transmission unit transmits said target value of the contrast ratio to said image display apparatus;

said target value obtaining unit obtains said target value of the contrast ratio from said calibration device; and said decision unit determines, based on the correlation relation stored in said second storage unit, a luminance change-over condition in which said target value of the contrast ratio obtained by said target value obtaining unit is contained within a range of the contrast ratios which can be displayed, and decides, based on the luminance change-over condition thus determined, the number of levels of change-over of the luminance of said backlight.

19. The image display system as set forth in claim 18, wherein said calibration device comprises:

an obtaining unit that obtains a measured value of the contrast ratio displayed on said image display apparatus in cases where the luminance of said backlight has been changed over under a predetermined luminance change-over condition; and a contrast ratio transmission unit that transmits information on said predetermined luminance change-over condition and the measured value of the contrast ratio obtained by said obtaining unit to said image display apparatus;

wherein said image display apparatus comprises a contrast ratio obtaining unit that obtains the information on said predetermined luminance change-over condition and the measured value of the contrast ratio from said calibration device; and with respect to the luminance change-over condition under which the measured value of the contrast ratio has been obtained by said obtaining unit in the correlation relation stored in said second storage unit, said decision unit determines whether said set target value of the contrast ratio is contained within the range of the measured value of the contrast ratios thus obtained.

20. The image display apparatus as set forth in claim 1, wherein the target value comprises a contrast ratio, a white color luminance, and a black color luminance.

* * * * *